US006019123A

United States Patent [19]

Gibbs

[11] Patent Number: 6,019,123

[45] Date of Patent: Feb. 1, 2000

[54] APPARATUS AND KIT FOR PREVENTING FREEZING IN PIPES

[76] Inventor: Robert Gibbs, 55 Farrarville Rd., Belmont, N.H. 03220

[21] Appl. No.: 09/053,470

[22] Filed: Apr. 1, 1998

Related U.S. Application Data

[60] Provisional application No. 60/070,528, Jan. 6, 1998.

[51] Int. Cl.[7] ..... F16K 49/00

[52] U.S. Cl. ..... 137/338; 137/334; 137/341; 138/33

[58] Field of Search ..... 137/334, 338, 137/341, 340, 899, 339; 138/33, 32

[56] References Cited

U.S. PATENT DOCUMENTS

| | | | |
|---|---|---|---|
| 2,327,910 | 8/1943 | Levine | 137/338 |
| 4,110,603 | 8/1978 | Peterson et al. | 137/341 |
| 4,199,002 | 4/1980 | Fumagalli | 137/334 |

*Primary Examiner*—A. Michael Chambers
*Assistant Examiner*—Thomas L. McShane
*Attorney, Agent, or Firm*—Michael J. Persson; William B. Ritchie

[57] ABSTRACT

The present invention is an apparatus and kit for preventing freezing in pipes. In its most basic form, the apparatus of the present invention includes three lengths of uninsulated flexible ductwork, each having a pair of connectors attached to each end, and a T-shaped adapter having three openings which are dimensioned to mate with one connector of each length of ductwork. In operation, the first length of ductwork, below the "T", is fitted over the downspout of the system and comes to rest in the system piping pit, the second length of ductwork is attached to a central heating duct and the third length is attached to the water inflow. Thus, when the central heating system is in operation, air is forced down the second duct to the "T" where substantially half of the warm air is directed to the piping pit and the other half is directed along the length of the exposed piping. In this manner, the pipes are heated without the use of expensive insulated ductwork and does not require the use of heat tape as a precauation. It is preferred that the apparatus be sold in kit form for installation by an owner of a mobile home. However, in some embodiments the apparatus may be preassembled or assembled on the job site by a heating professional.

20 Claims, 5 Drawing Sheets

APPARATUS AND KIT FOR PREVENTING FREEZING IN PIPES

This application claims benefit of Provisional Application No. 60/070,528 filed Jan. 6, 1998.

FIELD OF THE INVENTION

The present invention relates to the field of freeze prevention and, in particular, to apparatus and methods for preventing freezing of mobile home water lines.

BACKGROUND OF THE INVENTION

Mobile homes are, for many people, a cost-effective alternative to traditional housing. A mobile home is differentiated from a traditional, fixed, home in that there is generally no in-ground foundation on which the home is built. Instead of an in-ground foundation, a mobile home will generally sit on an above ground foundation consisting of cement blocks or the like. Piping, such as water piping will generally be installed below the floor of the mobile home and a space is usually left between the ground and the bottom of the mobile home to allow for piping to be accessed. In locations where temperatures seldom drop below freezing, the presence of piping in the space between the floor and the ground has little effect on the reliability of the system. However, in locations where temperatures drop and stay below freezing during the winter months, these under-floor pipes are prone to freezing.

A number of solutions have been developed in order to prevent freezing of water pipes. The most common of these solutions is to wrap a layer of electrical heating tape around the pipes and surround the heating tape with insulation. This solution is generally effective at keeping pipes from freezing. However, the electrical nature of the heating tape makes this solution a potentially deadly one as heating tapes are known to short circuit, causing the mobile homes to ignite and burn in a very short period of time. In fact, it is estimated that over one hundred deaths per year are attributable to fires caused by faulty heating tape in mobile homes. Therefore, there is a need for an apparatus to prevent freezing of exposed piping that does not pose a fire risk.

A number of United States patents address the problem of preventing water pipes from freezing. U.S. Pat. No. 5,318,059, titled "Methods and Apparatus for Prevention of Water Pipe Freeze-up In A Dwelling" describes a method whereby some of the cold water entering the dwelling is circulated into heat exchanging relationship with the hot water tank and is then caused to flow through a cold water main whenever a sensor senses the temperature has dropped below freezing. This method has not gained acceptance due to cost of installing the system and the requirement that water be discharged from the system whenever the temperature is below freezing. In addition, the subsequent freezing of discharged water when temperatures reach extreme cold temperatures can cause this system to fail, leaving the pipes unprotected. Therefore, there is a need for a cost effective method of preventing freezing that is not wasteful of water and eliminates the possibility that ice buildup will cause the system to fail.

U.S. Pat. No. 5,220,937, titled "Freeze Buster", discloses a water freeze prevention device that includes a mechanism that is installed between a water meter and incoming water pipes to drain the water pipes and prevent the pipes from freezing during severe cold weather. This system is effective at preventing freezing of the pipes but is also wasteful of water and requires time for pressure to be restored in the system following purge. Therefore, there is a need for a system that prevents freezing of pipes without interrupting the flow of cold water entering the home.

U.S. Pat. No. 4,798,239 utilizes a heat pipe that is buried in the ground at one end and located adjacent to the pipes that require freeze protection at the other end. This system is subsequently insulated and the heat pipe acts to use the warmth of the ground to heat the pipes. This system has not gained acceptance due to the high cost of the system and the variations in frost lines from location to location that prevents uniform application of its principles. Therefore, there is a need for a system that prevents freezing of pipes irrespective of the depth of the frost line at a given location.

U.S. Pat. No. 4,321,908, titled "Prevention of Freeze Damage to Liquid Conduits", describes a system that includes a sealed length of tubing, filled with an inert gas under pressure, which surrounds the piping. In this system, the inert gas acts both as an insulator and as a means of preventing expansion and bursting of the pipes should the pipes freeze. However, this system is costly as pressurization requires a tube which can act as a pressure vessel, is prone to failure due to leakage of the inert gas through pressure seals and does not alert a user that the pipes are unprotected until the pipes freeze. Therefore, there is a need for a system for preventing freezing in pipes which does not require pressurization and alerts a user when the pipes are unprotected.

Finally, U.S. Pat. No. 4,124,179 discloses a system that circulates air from the forced hot air heating system into a well hole and onward through the rest of the piping system. This system overcomes many of the problems addressed above as it is not dependent on the frost line at a particular location and alerts a user when the pipes are unprotected. However, this system also has drawbacks as the inadequacy of the air circulation pattern requires that insulated pipe is used, adding substantially to the system cost, and that heat tape also is applied as a precautionary measure to prevent freezing, creating the same fire hazard as with systems utilizing only heat tape.

There is not known in the art a system for preventing freezing of pipes in mobile homes that is cost effective, does not expose users to the risk of fire, is not wasteful of water, cannot fail due to ice buildup, is not dependent upon the frost line of a particular location, does not require pressurization, and alerts a user when the pipes are unprotected.

SUMMARY OF THE INVENTION

The present invention is an apparatus and kit for preventing freezing in pipes. In its most basic form, the apparatus of the present invention includes three lengths of uninsulated flexible ductwork, each having a pair of connectors attached to each end, and a T-shaped adapter having three openings which are dimensioned to mate with one connector of each length of ductwork. In operation, the first length of ductwork, below the "T", is fitted over the downspout of the system and comes to rest in the system piping pit, the second length of ductwork is attached to a central heating duct and the third length is attached to the water inflow. Thus, when the central heating system is in operation, air is forced down the second duct to the "T" where substantially half of the warm air is directed to the piping pit and the other half is directed along the length of the exposed piping. In this manner, the pipes are heated without the use of expensive insulated ductwork, does not require the use of heat tape as a precauation, and does not suffer from the drawbacks attendant to the water drainage and heat pipe systems described above.

In some embodiments where there is no piping pit, a separate enclosure is fitted at the end of the first length of piping to provide a heating area for the first length of piping. In other embodiments where forced hot water heating is used, the apparatus further includes a heater and blower for providing airflow to the ducts. In still other embodiments, a thermostat is installed on the pipes to send a signal to the activate the heating system when the pipes reach a predetermined temperature. In still other embodiments, a layer of insulation is disposed about the pipes prior to installing the conduits. It is preferred that the apparatus be sold in kit form for installation by an owner of a mobile home. However, in some embodiments the apparatus may be preassembled or assembled on the job site by a heating professional.

Therefore, it is an aspect of the present invention to provide a system for preventing freezing in water pipes that is cost effective both to purchase and to install.

It is a further aspect of the present invention to provide a system for preventing freezing in water pipes that does not expose users to the risk of fire.

It is a further aspect of the present invention to provide a system for preventing freezing in water pipes that is not wasteful of water.

It is a further aspect of the present invention to provide a system for preventing freezing in water pipes that cannot fail due to ice buildup.

It is a further aspect of the present invention to provide a system for preventing freezing in water pipes that is not dependent upon the frost line of a particular location.

It is a further aspect of the present invention to provide a system for preventing freezing in water pipes that does not require pressurization.

It is a still further aspect of the present invention to provide a system for preventing freezing in water pipes that alerts a user when the pipes are unprotected.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

The present invention is an apparatus and system for preventing freezing in pipes and, in particular, for preventing freezing of pipes in mobile homes. The system circulates forced hot air from the home's central heating system, or from a separate heater and blower, through ducts surrounding the pipes to adequately heat exposed piping to a temperature above the freezing point of the water within the pipes.

Figure 1:
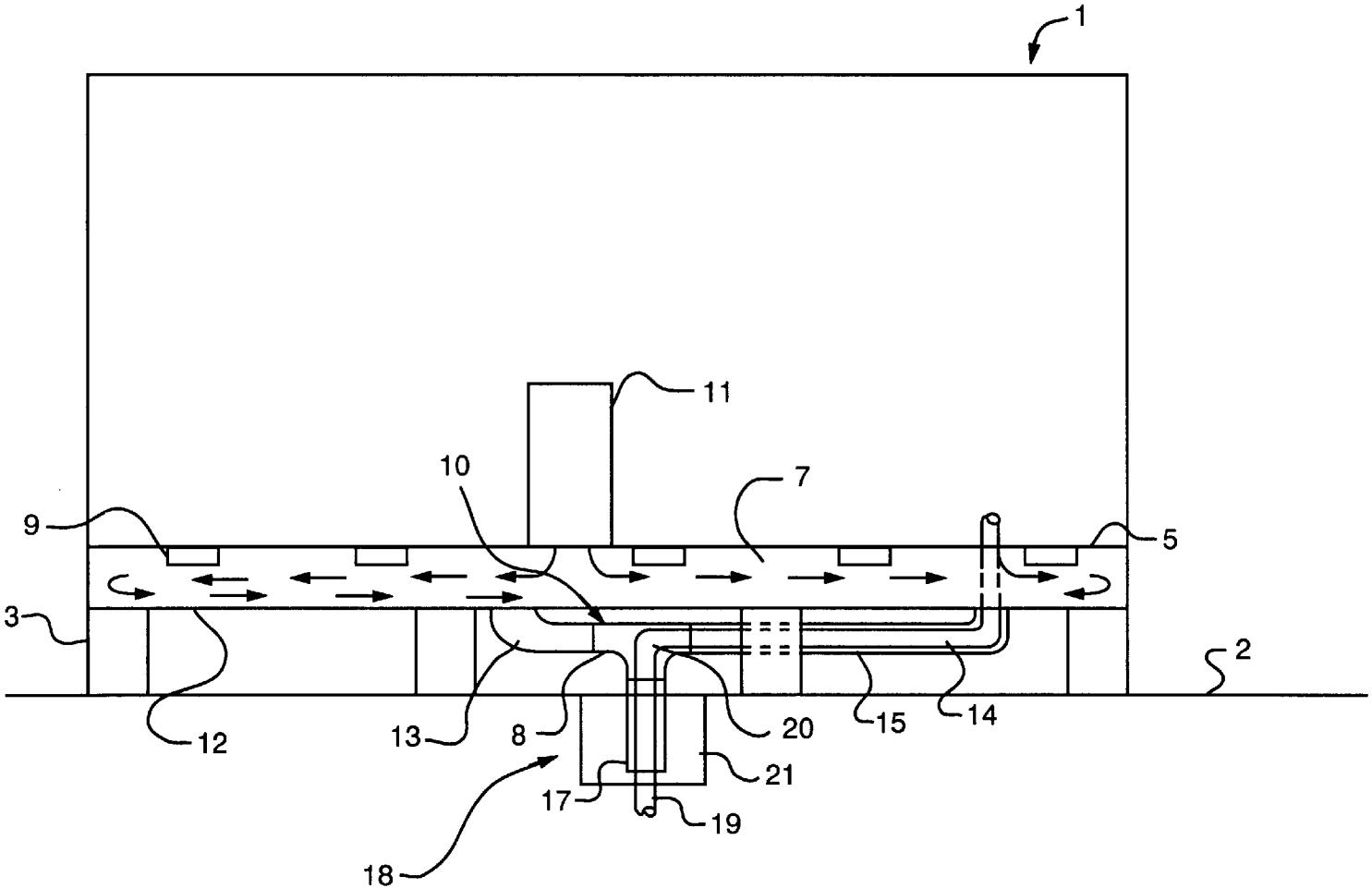
FIG. 1 is a schematic view of the basic embodiment of the system of the present invention.

Referring first to FIG. 1, a schematic view of the basic embodiment of the system of the present invention is shown. A mobile home 1 will typically be raised above ground level 2 by a series of cement blocks 3 spaced at regular intervals. In this embodiment, the mobile home 1 has a forced hot air heating system 11 that heats and circulates air through a main heating duct 7 beneath the floor 5 of the mobile home 1. Air is forced into the main heating duct 7 by the heating system 11 causing a positive pressure to build within the duct 7, causing the heated air to flow through a series of registers 9 in the floor to heat the interior of the mobile home 1. As not all of the air will pass through the registers 9, heated air will remain in the main heating duct 7 and generally follow the flow pattern denoted by the arrows in FIG. 1.

A typical water supply for a mobile home 1 includes a water inlet 19 running through the ground 18 and into a piping pit 21 dug out of the ground and surrounding the water inlet 19. Piping pits 21 are generally dug to a level below a predetermined frost line for the given location and provide space for valving, water meters or other service related equipment. Although location of the water inlet 19 is shown in FIG. 1 as being located at the approximate center of the mobile home 1, the water inlet 19 has no fixed location but rather may be located at any point underneath the mobile home 1. Because of these differences in location, the water inlet 19 will generally run upwards from the ground 18 through the piping pit 21 and bend at a right angle 21 below the bottom 12 of the mobile home 1 into a water pipe 14. Water pipe 14 will generally run parallel to the bottom 12 of the mobile home 1 until it reaches a desired point, below a hot water heater or internal valve box (not shown) within the mobile home 1, at which point the pipe will bend again and enter the interior of the mobile home 1.

As shown in FIG. 1, the apparatus 10 of this embodiment of the present invention includes an air inlet duct 13, a T-adapter 8, a water inlet duct 17, and a water pipe duct 15 arranged to effectively tap the hot air circulating within the main heating duct 7 to provide hot air to the water inlet 19 and water pipe 14. Air inlet duct 13 is attached in fluid communication with main heating duct 7. As noted above, not all of the hot air is passed through the floor registers 9 and the excess will continue to circulate within the main heating duct 7 at a positive pressure. By tapping the air inlet duct 17 into the main heating duct 7, a pressurized flow of this heated air is forced into the apparatus through the air inlet duct 17 and flows to the T-adapter 8. Upon reaching the T-adapter 8, the flow of heated air will be divided with a portion flowing through the water inlet duct 17 into the piping pit 21 and another portion flowing through the water pipe duct 15 to heat the water pipe 14. In this manner, both the water inlet 19 and the water pipe 14 receive sufficient air to effectively maintain the temperature of the pipes above the freezing point of water.

Figure 2:
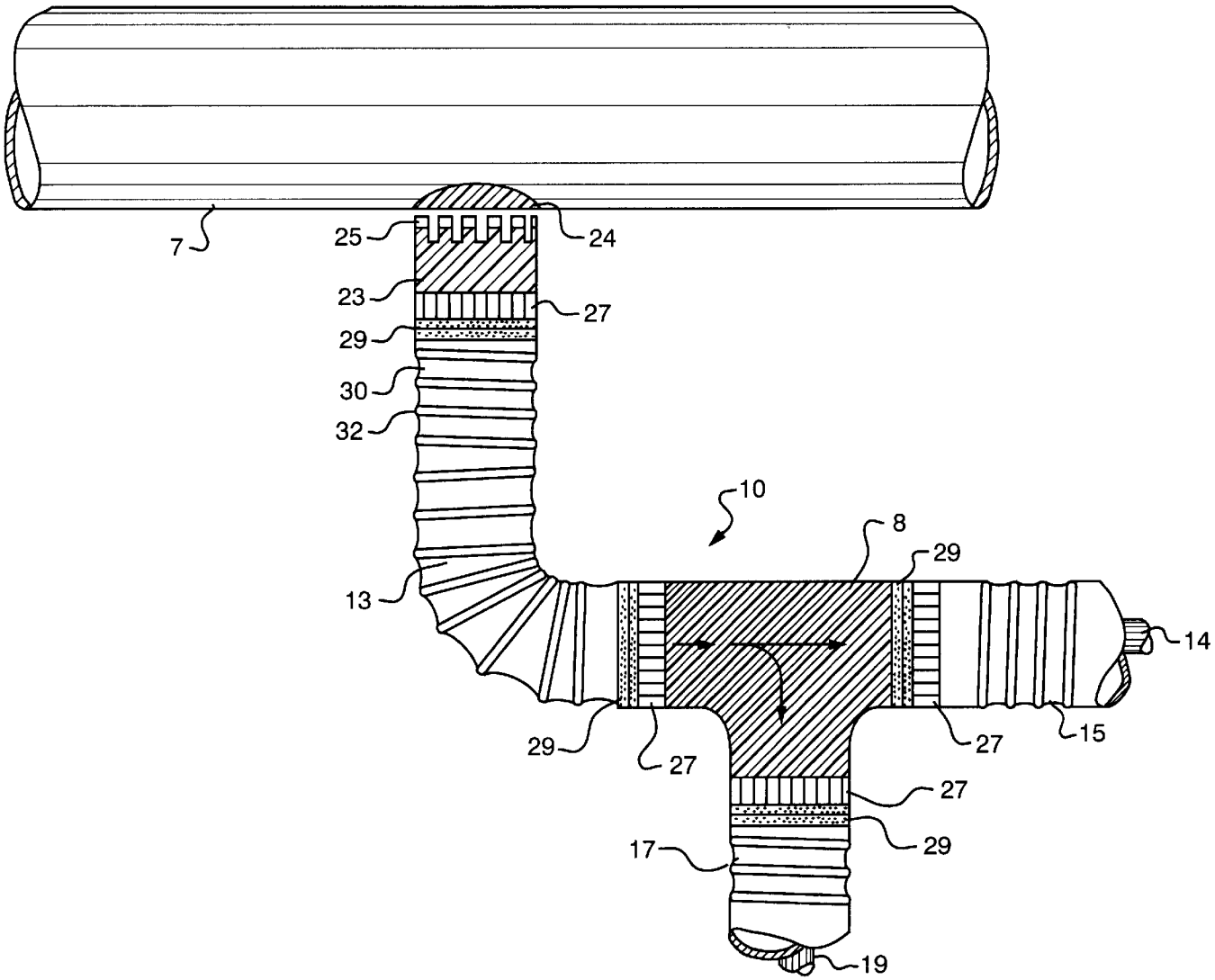
FIG. 2 is a sectional view of the apparatus of the present invention showing the conduits, T-shaped adapters and connectors.

Referring now to FIG. 2, an enlarged sectional view of the apparatus 10 of FIG. 1 is shown. As disclosed above, apparatus 10 includes air inlet duct 13, T-adapter 8, water inlet duct 17, and water pipe duct 15. In the preferred embodiment of the invention, ducts 13, 15, 17 are formed of a flexible polymer 30 disposed over a metal wire 32 that is formed into a helical configuration of four inch diameter. This preferred ducting is of the same type as the uninsulated flexible duct that is commonly used as exhaust ducting for clothes dryers. However, other types of flexible ducts, either insulated or uninsulated, may be substituted to achieve similar results.

Each of the three ducts 13, 15, 17 are attached at one end to T-adapter 8. In the preferred embodiment, the apparatus is sold a kit and ducts 13, 15, 17 are provided as separate pieces that attach to the T-adapter 8 by attaching a sleeve 27 to the end of the duct with a heat resistant tape 29 and inserting the sleeve 27 into one of the openings of the T-adapter 8, where it is held by friction. However, in other embodiments, the ends of the ducts 13, 15, 17 are attached directly to the T-adapter 8 by conventional hose clamps while, in still other embodiments, the apparatus is sold as one piece and the ducts 13, 15, 17 are preassembled to the T-adapter 8 by fasteners such as rivets or bolts.

As shown in FIG. 2, air inlet duct 13 attaches at one end to the main heating duct 7 through an opening 24 cut into the main heating duct 7. Opening 24 is dimensioned to accept a take-off 25 fitted onto the sleeve 27 secured at the end of the air inlet duct 13 by heat resistant tape 29. In the preferred embodiment, take-off 25 is a standard four inch take-off having a series of fingers 24 that enter the main heating duct 7 and secure the air inlet duct 13 in fluid communication with the main heating duct 7. However, in other embodiments, standard adapters may be fitted into opening 24 such that air inlet duct 13 may be secured without take-off 23 or sleeve 27 in a manner similar to those discussed above with respect to fastening the ducts to the T-adapter 8. Air inlet duct 13 may be positioned at any point along the main heating duct 7 and thus the present system may be adapted in many ways to meet the needs of the mobile homeowner.

Heated air enters the assembly 10 through the air inlet duct 13 and flows to T-adapter 8. As denoted in FIG. 2 by the arrows on T-adapter 8, the heated air is split in the T-adapter 8 such that it flows downward through the water inlet duct 17 to the heat water inlet 19 and through water pipe duct 15 to heat water pipe 14. This ducting arrangement, which splits the flow into two separate streams, is an important element of the present invention as it allows both the water inlet 19 and the water pipe 14 to be protected without the need for expensive insulated ducts or dangerous heat tapes. This is due to the fact that the heated air is not passed over the cold water inlet before having to heat the water pipe, as is the case in the prior art. This "series" arrangement of the prior art renders the water pipe 14 vulnerable to freezing and necessitates use of the insulated ducts and additional heat tapes avoid by utilizing the "parallel" arrangement of the present invention.

Figure 3:
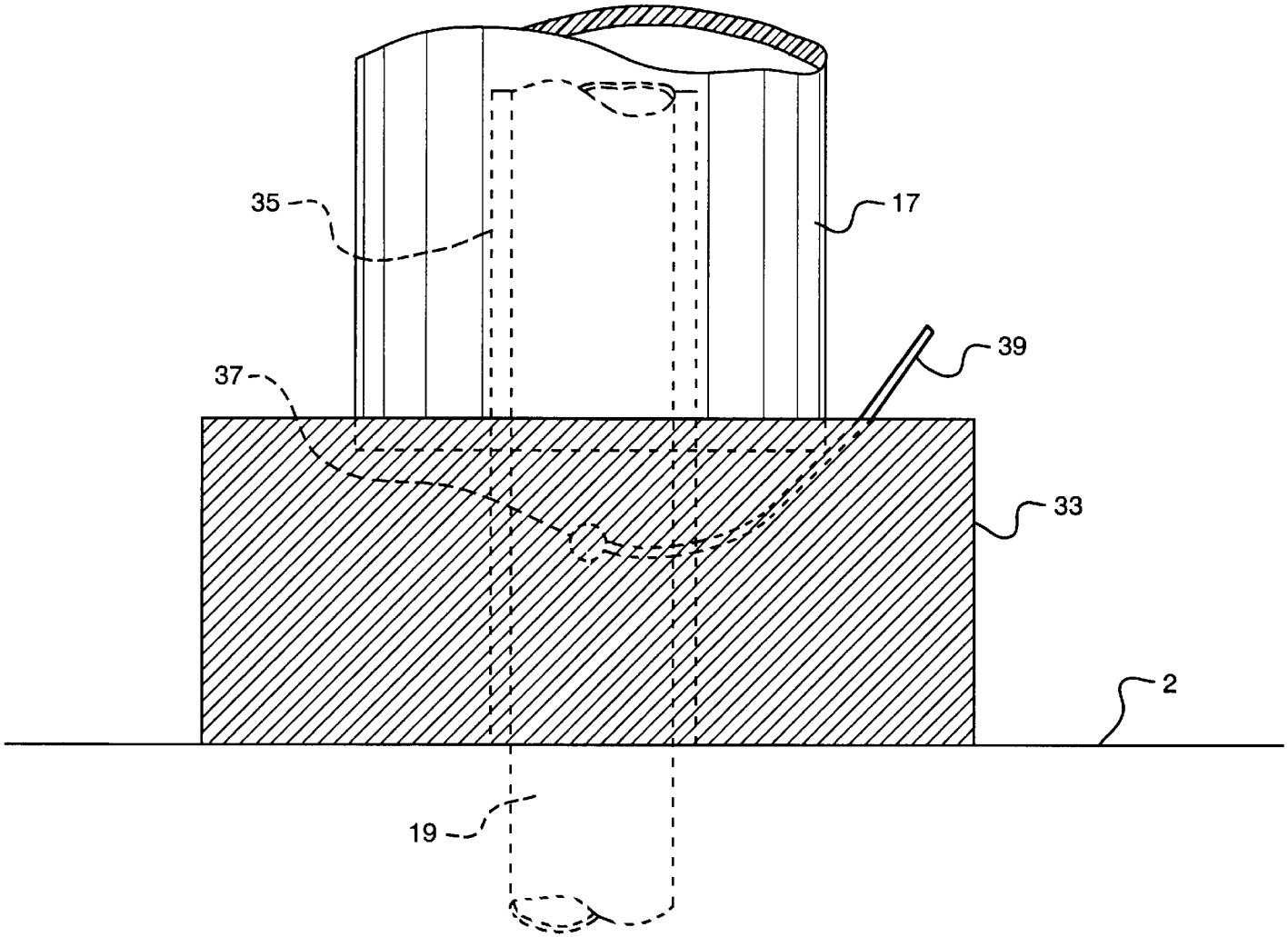
FIG. 3 is a schematic view of an embodiment of the present invention utilizing a insulation over the piping and a thermostat to measure pipe temperature.

Referring now to FIG. 3, a sectional view of the water inlet duct in another embodiment of the present invention. The embodiment of FIG. 3 shows a water inlet 19 that does not utilize a piping pit, but rather extends directly through the surface of the ground. Under these circumstances, it is desirable to utilize a circulation vessel 33 that allows the warmed air to circulate about, and heat, the water inlet 19 and the ground surrounding the inlet. In this embodiment, the circulation vessel 33 is a metal bucket, placed open end down on the ground, having an opening in its closed end to accept the end of water inlet duct 17. However, other circulation vessels 33, piping pits and/or combinations of the two may also be utilized to achieve similar results.

The embodiment of FIG. 3 also utilizes insulation 35 over the piping and a thermocouple 37 to measure pipe temperature. Though not required, insulation of the piping is preferred in water systems utilizing metal pipes as the metal pipes conduct more heat away from the pipes when cold and speed freezing. The insulation 35 of FIG. 3 is a urethane foam type insulation commonly used in the plumbing arts. However, other types of insulation, such as fiberglass, may also be used to achieve similar results.

The thermocouple 37 is added as a separate safety check on the system. In some circumstances, a mobile home owner may use a wood stove or other space heater to warm the house rather than the central heating system. In these cases, the thermocouple 37 is tied into the thermostat in the furnace by cable 39, and when the temperature of the pipes drops below a predetermined threshold, the furnace is activated to heat the pipes. Like the insulation 35 discussed above, the thermocouple 37 of this embodiment may be used in any of the described embodiments as a safety feature to provide further protection from freezing pipes.

Figure 4:
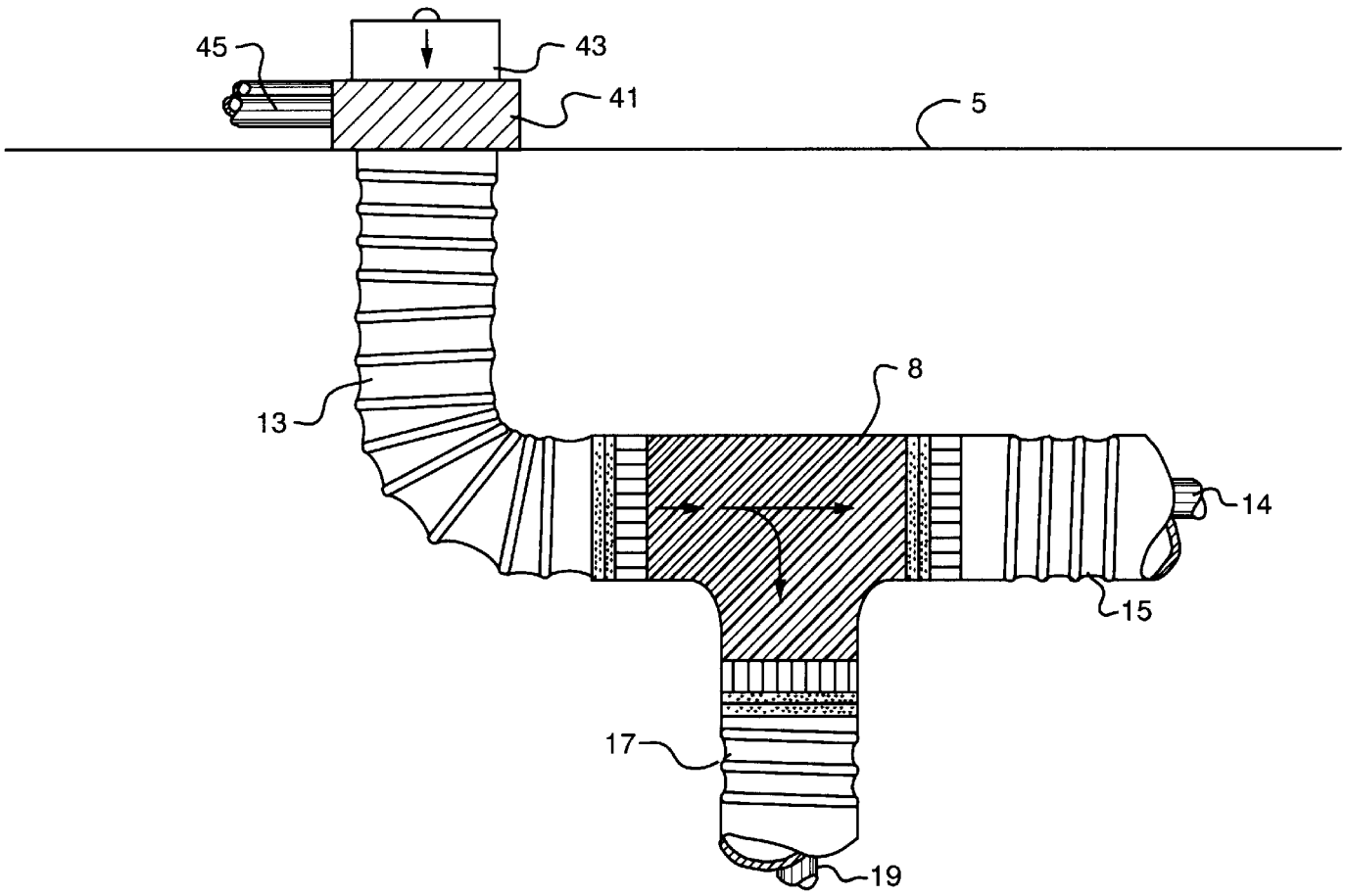
FIG. 4 is a schematic view of the system of the present invention for use in mobile homes with forced hot water heating systems utilizing a separate heater and blower system.

Referring now to FIG. 4, an alternative embodiment of the present invention for use in mobile homes having forced hot water style heating systems, is shown. In this embodiment, air inlet duct 13 is fed through a hole in the floor 5 of the mobile home and attaches to a heating element 41 through which air is blown by blower 43. In this embodiment, heating element 41 is similar to a car radiator as it has a series of finned tubes through which hot water is fed from the hot water pipes 45 of the heating system. However, in other embodiments, electric heaters with blowers may also be utilized to achieve similar results.

Figure 5:
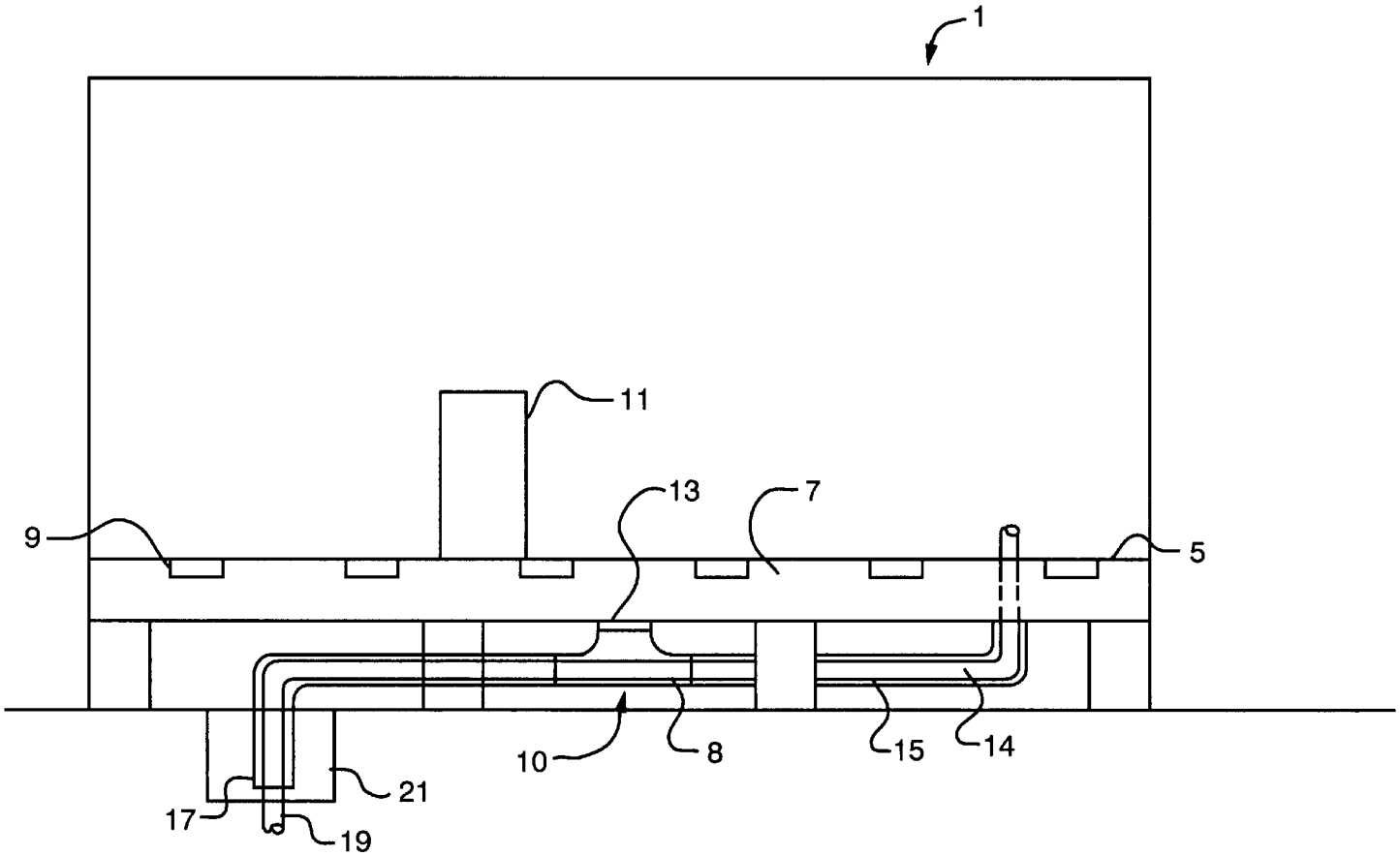
FIG. 5 is a schematic view of the preferred embodiment of the system of the present invention.

Referring now to FIG. 5, a schematic view of the preferred embodiment of the present invention is shown. The preferred embodiment of the apparatus 10 of the present invention is similar in all respects to the embodiments described with reference to FIGS. 1–4, except that the T-adapter 8 is reversed such that the air inlet duct 13 is attached to the single inlet of the T-adapter 8 to split the air flow between the water inlet duct 17 and the water pipe duct 15. This arrangement provides optimum air flow to both the water inlet duct 17 and water pipe duct 15 and reduces the length of the air inlet duct 13 required for attachment to the main heating duct 7. Using this arrangement, it is also possible, in some cases, to eliminate air inlet duct 13 completely and to attach T-adapter 8 directly to the main heating duct 7.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An apparatus for preventing freezing of a liquid disposed within a water inlet pipe and a water pipe, said apparatus comprising;

an air inlet duct having two ends, wherein one of said two ends is dimensioned for attachment to a source of pressurized heated air;

a water inlet duct having two ends and being dimensioned to surround the water inlet pipe;

a water pipe duct having two ends and being dimensioned to surround the water pipe; and a T-adapter having a first opening, a second opening and a third opening, wherein said first opening is attached to one end of said air inlet duct, said second opening is attached to one end of said water inlet duct, and said third opening is attached to one end of said water pipe duct;

wherein the pressurized heated air is forced through said air inlet duct and into said T-adapter where the pressurized heated air is split to travel through said water inlet duct and said water pipe duct, effectively heating the water inlet and water pipe such that the fluid disposed within said water inlet and said water pipe is prevented from freezing.

2. The apparatus as claimed in claim 1 wherein said air inlet duct, said water inlet duct, and said water pipe duct are substantially flexible.

3. The apparatus as claimed in claim 2 wherein said air inlet duct, said water inlet duct, and said water pipe duct are formed of a flexible polymer disposed over a wire, said wire being formed in a helical configuration.

4. The apparatus as claimed in claim 1 wherein said air inlet duct comprises a take-off attached at one end of said air inlet duct, said take-off being dimensioned for attachment to the source of pressurized heated air.

5. The apparatus as claimed in claim 4 wherein said air inlet duct further comprises a sleeve attached to one end of said air inlet duct, said sleeve being dimensioned to attach said take-off to said air inlet duct.

6. The apparatus as claimed in claim 5 wherein said air inlet duct further comprises a heat resistant tape to attach said sleeve to one end of said air inlet duct.

7. The apparatus as claimed in claim 1 further comprising at least one sleeve for attaching one end of at least one of said air inlet duct, said water inlet duct, and said water pipe duct to at least one opening of said T-adapter.

8. The apparatus as claimed in claim 7 comprising a first sleeve for attaching one end of said air inlet duct to said first opening of said T-adapter, a second sleeve for attaching one end of said water inlet duct to said second opening of said T-adapter, and a third sleeve for attaching one end of said water pipe duct to said third opening of said T-adapter.

9. The apparatus as claimed in claim 8 wherein said first sleeve, said second sleeve and said third sleeve are attached to said air inlet duct, said water inlet duct and said water pipe duct by heat resistant tape.

10. The apparatus as claimed in claim 1 wherein said air inlet duct is formed integral to said T-adapter.

11. The apparatus as claimed in claim 1 further comprising at least one thermocouple extending through at least one of said ducts for measuring a temperature of at least one of the pipes.

12. The apparatus as claimed in claim 1 further comprising a source of pressurized heated air.

13. The apparatus as claimed in claim 12 wherein said source of pressurized heated air comprises a heater in fluid communication with said air inlet duct and a blower for pressurizing air heated by said heater such that said pressurized heated air is caused to flow through said air inlet duct.

14. The apparatus as claimed in claim 1 further comprising a circulation vessel attached to one end of said water inlet duct.

15. A kit of parts for preventing freezing of water in a water inlet pipe and a water pipe, said kit comprising:

an air inlet duct having two ends, wherein one of said two ends is dimensioned for attachment to a source of pressurized heated air;

a water inlet duct having two ends and being dimensioned to surround the water inlet pipe;

a water pipe duct having two ends and being dimensioned to surround the water pipe; and a T-adapter having a first opening, a second opening and a third opening, wherein said first opening is dimensioned for attachment to one end of said air inlet duct, said second opening is dimensioned for attachment to one end of said water inlet duct, and said third opening is dimensioned for attachment to one end of said water pipe duct.

16. The kit as claimed in claim 15 further comprising a take-off dimensioned at one end for attachment to one end of said air inlet duct and dimensioned at another end for attachment to the source of pressurized heated air.

17. The kit as claimed in claim 15 further comprising attachment means for attaching one end of said air inlet duct to said first opening of said T-adapter, for attaching one end of said water inlet duct to said second opening of said T-adapter, and for attaching one end of said water pipe duct to said third opening of said T-adapter.

18. The kit as claimed in claim 17 wherein said attachment means comprises three sleeves and a predetermined length of heat resistant tape.

19. The kit as claimed in claim 15 further comprising a source of pressurized heated air.

20. The apparatus as claimed in claim 19 wherein said source of pressurized heated air comprises a heater dimensioned for attachment in fluid communication with said air inlet duct and a blower dimensioned for attachment to said heater for pressurizing air heated by said heater.

* * * * *